United States Patent [19]

von König et al.

[11] 3,951,664

[45] Apr. 20, 1976

[54] LIGHT-SENSITIVE MATERIAL HAVING DEVELOPERS EMBEDDED THEREIN

[75] Inventors: Anita von König, Leverkusen; Helmut Kampfer; Ernst Roos, both of Cologne; Kurt Ley, Leverkusen, all of Germany

[73] Assignee: AGFA-Gevaert, A.G., Leverkusen, Germany

[22] Filed: June 24, 1974

[21] Appl. No.: 482,228

Related U.S. Application Data

[62] Division of Ser. No. 156,047, June 23, 1971, Pat. No. 3,819,382.

[30] Foreign Application Priority Data

June 26, 1970 Germany ..... 2031748

[52] U.S. Cl. ..... 96/95; 96/76 R; 96/66 T

[51] Int. Cl.[2] ..... G03C 1/06; G03C 5/30

[58] Field of Search..... 96/95, 67, 66, 76, 66 T

[56] References Cited

UNITED STATES PATENTS

| | | | |
|---|---|---|---|
| 3,262,781 | 7/1966 | Ryan et al. | 96/95 |
| 3,554,750 | 1/1971 | Weyde et al. | 96/95 |
| 3,574,627 | 4/1971 | Stern et al. | 96/3 |
| 3,577,236 | 5/1971 | Fix | 96/3 |
| 3,615,439 | 10/1971 | Oftedahl, Jr. | 96/66 R |
| 3,615,521 | 10/1971 | Oftedahl, Jr. | 96/66 R |

*Primary Examiner*—Mary F. Kelley
*Attorney, Agent, or Firm*—Connolly and Hutz

[57] ABSTRACT

A photographic material having a light-sensitive silver salt emulsion layer which layer contains a silver salt developer of the chroman series having the formula defined below.

7 Claims, No Drawings

LIGHT-SENSITIVE MATERIAL HAVING DEVELOPERS EMBEDDED THEREIN

This application is a division of the copending U.S. application Ser. No. 156,047 filed June 23, 1971 for "Light-Sensitive Material Having Developers Embedded Therein", issued as U.S. Pat. No. 3,819,382 on June 25, 1974.

The invention relates to a light-sensitive photographic material which contains developer substances in particular in those layers which contain silver salts.

The principle of embedding developer substances in photographic emulsion layers has been known for a long time but the substances conventionally used for this purpose, which are based on aromatic compounds substituted with hydroxyl or amino groups, do not satisfy all the requirements in practice. Some of these compounds do not have a sufficiently powerful development action, whereas those which are sufficiently powerful developers diminish the stability in storage of the light-sensitive layers. The reason for this is the sensitivity of the developers to oxidation with atmospheric oxygen.

The photographic processes for processing exposed, light-sensitive materials which contain embedded developer substances may be subdivided into two main groups, one group comprising those processes in which aqueous treatment baths are used, whereas the other group comprises processes in which the exposed photographic materials are processed at elevated temperature without the use of development baths.

In the first group of processes, the materials are developed simply by the action of an alkaline solution and are stabilized against further changes by light by means of stabilizer baths or by fixing and washing with water. The heat copying processes belong to the second group.

The principle of heat copying processes has been described in German Patent Specification No. 880,045 and involves developing the material by simply heating it after exposure. The process described in German Patent Specification No. 1,300,014 also belongs to the heat copying type of process. In the process described in the said Patent Specification, photographic recording materials are used which contain an oxidizing agent, a reducing agent and a minor quantity of a light-sensitive substance whose photolytic products initiate the redox reaction which is accompanied by production of color. The oxidizing agents used in this process are organic silver salts and the reducing agents are aminophenols, hydroxylamines, pyrazolidones or phenols. Phenylene diamine and etherified napththols, e.g. 4-methoxy-naphtol-1, have also been described for this purpose. Compounds suitable for use as light-sensitive compounds are heavy metal salts which form traces of the free metal on exposure to light, especially light-sensitive silver salts such as silver halides which form silver by a photolytic reaction on exposure to light. These photolytic heavy metal nuclei initiate the redox reaction.

The materials used in the said process also have the above mentioned disadvantage of being relatively unstable in storage due to the sensitivity of the reducing agents to oxidation by atmospheric oxygen. To obtain sufficient stability in storage for practical requirements, it is, therefore, necessary to take additional steps to protect the reducing agents against the action of atmospheric oxygen. This is achieved mainly by the addition of antioxidants.

It is among the objects of the invention to provide a photographic material which contains silver salt and embedded developer substance suitable for wet or dry development processes, which developers should have a sufficiently powerful development action and sufficient resistance to oxidation in order to enable photographic images of high quality to be produced from a material of sufficient stability in storage.

It has now been found that compounds of the following general formula are eminently suitable developer substances or reducing agents for this purpose:

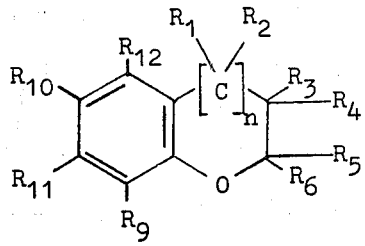

wherein represents $n = 0$ or 1;

$R_1$, $R_2$, $R_3$, $R_4$, $R_5$ and $R_6$ = hydrogen or alkyl groups having up to 9 carbon atoms, preferably methyl groups;

$R_3$ and $R_4$ or $R_4$ and $R_5$ may be joined together to complete a carbocyclic ring system having 5, 6 or 7 carbon atoms which can contain a double bond and/or which can be substituted by alkyl groups having up to 4 carbon atoms;

$R_6$ may further stand for an alkoxy group having up to 6 carbon atoms or a tertiary amino group of the following formula:

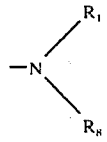

wherein $R_7$ and $R_8$ represent alkyl having up to 6 carbon atoms or together the ring members required for completing a 5-membered, 6-membered or 7-membered ring, which rings may contain an oxygen atom or additional nitrogen atom as ring member in addition to the nitrogen atom already present;

$R_9$ and $R_{10}$ = hydrogen, alkyl or alkoxy having up to 6 carbon atoms, preferably methyl or tertiary alkyl groups, or hydroxyl groups, at least one of the radicals $R_9$ and $R_{10}$ representing a hydroxyl group;

$R_{11}$ and $R_{12}$ = hydrogen, alkyl or alkoxy having up to 9 carbon atoms, preferably methyl or tertiary alkyl groups, cycloalkyl such as cyclopentyl or cyclohexyl, aralkyl such as benzyl or phenyl ethyl, or aryl, especially a phenyl ring, or a group of the formula:

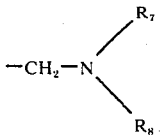

wherein $R_7$ and $R_8$ have the meanings already indicated.

The following are examples of suitable compounds:

1. 2-methyl-6-hydroxy-chroman,
2. 2,2-dimethyl-6-hydroxy-chroman,
3. 2,2,3-trimethyl-6-hydroxy-chroman,
4. 2,2-dimethyl-7-tert-butyl-6-hydroxy-chroman,
5. 2,2-dimethyl-8-tert-butyl-6-hydroxy-chroman,
6. 2,2-dimethyl-7-tert-amyl-6-hydroxy-chroman,
7. 2,2-dimethyl-7-tert-octyl-6-hydroxy-chroman,
8. 2,2-dimethyl-7-cyclopentyl-6-hydroxy-chroman,
9. 2,2-dimethyl-7-cyclohexyl-6-hydroxy-chroman,
10. 2,2-dimethyl-7-(1-methylcyclohexyl)-6-hydroxy-chroman,
11. 2,2-dimethyl-7-(2-phenyl ethyl)-6-hydroxy-chroman,
12. 2,2-dimethyl-7-(2-methyl-2-phenyl ethyl)-6-hydroxy-chroman,
13. 2,2-dimethyl-7-phenyl-6-hydroxy-chroman,
14. 2,2,7-trimethyl-6-hydroxy-chroman,
15. 2,2,3,4-tetramethyl-6-hydroxy-chroman,
16. 2,2,5-trimethyl-7,8-dimethoxy-6-hydroxy-chroman,
17. 2,2,5,7,8-pentamethyl-6-hydroxy-chroman,
18. 2-dimethylamino-3,3-dimethyl-5-hydroxy-coumaran,
19. 2-diethylamino-3,3-dimethyl-5-hydroxy-coumaran,
20. 2-pyrrolidino-3,3-dimethyl-5-hydroxy-coumaran,
21. 2-piperidino-3,3-dimethyl-5-hydroxy-coumaran,
22. 2-morpholino-3,3-dimethyl-5-hydroxy-coumaran,
23. 2-morpholino-3,3-dimethyl-6-tert-butyl-5-hydroxy-coumaran,
24. 2-pyrrolidino-3,3-dimethyl-6-tert-butyl-5-hydroxy-coumaran,
25. 2-piperidino-3,3-dimethyl-6-tert-butyl-5-hydroxy-coumaran,
26. 2-morpholino-3,3-dimethyl-6-tert-octyl-5-hydroxy-coumaran,
27. 2-morpholino-3,3-dimethyl-6-phenyl-5-hydroxy-coumaran,
28. 2-pyrrolidino-3,3-(spiro-cyclohexen-(3)-yl)-5-hydroxy-coumaran,
29. 2-morpholino-3,3-(spiro-cyclohexyl)-5-hydroxy-coumaran,
30. 2-piperidino-3,3-(spiro-cyclohexen-(3)-yl)-5-hydroxy-coumaran,
31. 2-morpholino-3,3-(spiro-3-methyl-cyclohexen-(3)-yl)-5-hydroxy-coumaran,
32. 2-morpholino-3,3-dimethyl-6-morpholine-methyl-5-hydroxy-coumaran,
33. 2-morpholino-3,3-(spiro-4-methyl-cyclohexen-(3)-yl)-5-hydroxy-coumaran,
34. 2-morpholino-3,3-(spiro-4-methyl-cyclohexen-(3)-yl)-6-morpholino-methyl-5-hydroxy-coumaran,
35. 2-morpholino-2,3-tetramethylene-5-hydroxy-coumaran,
36. 2,2-dimethyl-7-hydroxy-coumaran,
37. 2,2-dimethyl-6-tert-butyl-7-hydroxy-coumaran, 38. 2-methoxy-3,3-dimethyl-5-hydroxy-coumaran,
39. 2-methoxy-3,3-dimethyl-6-tert-octyl-5-hydroxy-coumaran,
40. 2-ethoxy-3,3-dimethyl-5-hydroxy-coumaran,
41. 2-methoxy-3,3-(spiro-4-methyl-cyclohexen-(3)-yl)-5-hydroxy-coumaran,
42. 2-n-butyloxy-3,3-dimethyl-6-tert-butyl-5-hydroxy-coumaran,
43. compound of the constitution:

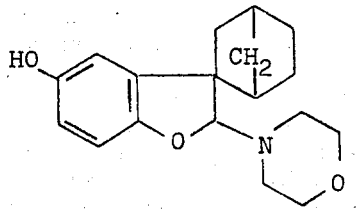

The process of preparing the compounds to be used according to the invention is known and has been described inter alia in U.S. Pat. Specification No. 2,535,078 and 3,160,637 and in German Patent Specification No. 1,163,837.

The photographic materials according to the invention which contain one or more of the developer substances to be used according to the invention are not in principle subject to any restrictions as regards their photographic application. They may be used wherever light-sensitive materials which contain developer substances are required. They may be used both for wet and for dry processing methods.

The photographic materials according to the invention are suitable for both groups of processes. The optimum developer substances for any given photographic process can be selected by means of simple tests.

The materials according to the invention may contain both silver halides and organic silver salts, e.g. the silver salts of carboxyalkylthio derivatives or silver salts of carboxylic acids as described in British Patent Specification Nos. 1,111,492 and 1,110,046 or mixtures of these silver salts. These silver salts are sufficiently light-sensitive if precipitated in the presence of a protective colloid such as gelatin.

Any silver halide emulsions may be used for producing the silver halide emulsion layers, such as silver chloride, silver bromide or silver chlorobromide emulsions, and they may also contain up to 10 mols % of silver iodide. These emulsions may contain 0.05 to 0.5 mol of silver halide per liter. For wet processing and for thermal development, the layers may contain the organic silver salts of carboxyalkylthio derivatives described in British Patent Specification No. 1,111,492 instead of silver halides or in admixture with silver halides.

The binder used for the photographic layers is preferably gelatin but this may be partly or completely replaced by other natural or synthetic binders. Suitable natural binders are e.g. alginic acid and its derivatives such as salts, esters or amides, cellulose derivatives such as carboxymethyl cellulose, alkyl cellulose such as hydroxyethyl cellulose, starch or its derivatives such as esters or esters or carrageenates. Suitable synthetic binders are e.g. polyvinyl alcohol, pertially saponified polyvinyl acetate or polyvinyl pyrrolidone and the like.

The binder mixtures of gelatin and cellulose acetate described in German Auslegeschrift No. 2,000,926 may also be used, the gelatin solution for the layer being in that case mixed in the presence of phthalic acid in quantities of 10 to 50 % by weight, based on the total amount of solids in the mixture, with cellulsoe acetate having an acetic acid content of between 30 and 50 % by weight. The emulsions may also be chemically sensitized, e.g. by adding compounds which contain sulfur, such as allyl isothiocyanate, allyl thiourea or sodium thiosulfate and the like, at the stage of chemical ripening. Reducing agents may also be used as chemical sensitizers, e.g. the tin compounds described in Belgian Patent Specifications No. 493,464 and 568,687, polyamines such as diethylene triamine or formamidine sulfinic acid derivatives, e.g. according to Belgian Patent Specification No. 547,323.

Noble metals and noble metal compounds, e.g. gold, platinum, palladium, iridium, ruthenium and rhodium, are also suitable for use as chemical sensitizers. This method of chemical sensitization has been described in the article by R. KOSLOWSKY, Z. Wiss. Phot. 46, 65–72 (1951).

The emulsions may also be sensitized with polyalkylene oxide derivatives, e.g. with polyethylene oxide having a molecular weight of between 1000 and 20,000, with condensation products of alkylene oxides and aliphatic alcohols, glycols or cyclic dehydration products of hexitols or with alkyl substituted phenols, aliphatic carboxylic acids, aliphatic amines, aliphatic diamines and amides. The condensation products have a molecular weight of at least 700 and preferably more than 1000. These sensitizers may, of course, be combined in order to achieve special effects, as described in Belgian Patent Specification No. 537,278 and in British Patent Specification No. 727,982.

The emulsions may also be spectrally sensitized, e.g. with the usual polymethine dyes such as merocyanines, basic or acid carbocyanines, rhodacyanines, hemicyanines, styryl dyes or oxonoles. Sensitizers of this type have been described in the work by F. M. HAMER "The Cyanine Dyes and Related Compounds" (1964).

The emulsions may contain the usual stabilizers, e.g. homopolar or salt-type compounds of mercury which have aromatic or heterocyclic rings, such as mercaptotriazoles, simple mercury salts, sulfonium mercury double salts and other mercury compounds. Azaindenes are also suitable for use as stabilizers, especially tetra- or penta-azaindenes and especially those which are substituted with hydroxyl or amino groups.

Compounds of this type have been described in the article by BIRR, Z. Wiss. Phot. 74, 2–58 (1952). Other suitable stabilizers are e.g. heterocyclic mercapto compounds such as phenyl mercaptotetrazole, quaternary benzothiazole derivatives, benzotriazoles or the substituted 4-aminobenzotriazoles described in British Patent No. 919,061.

The emulsions may be hardened for wet processing in the usual manner, for example with formaldehyde or halo-substituted aldehydes which contain a carboxyl group, such as mucobromic acid, diketones, methane sulfonic acid esters or dialdehydes.

When using the light-sensitive materials according to the invention for heat copying processes, it is advisable also to add other substances, for example matting agents such as starch ether, dextrin, colloidal silicic acid or finely dispersed silicon dioxide aluminium oxide or titanium dioxide. For some heat copying processes, it has been found especially advantageous to add substances which impart a certain moisture to the light-sensitive layer and/or the image receiving layer during the heat development. This group of substances includes substances which split off water at elevated temperature or hydrophilic compounds which increase the residual moisture of the layer. Substances of the first mentioned type are ureas, caprolactam, β-nitroethanols or β-cyanoethanols as described in German Patent Specification No. 1,174,159 or salts which form clearly defined hydrates, such as sodium acetate, sodium citrate or sodium sulfate. Compounds of the second type mentioned include glycols, polyethylene glycols, glycerol, sorbitol or mono- or oligo-saccharides. These substances are added to the casting solutions for the light-sensitive layer in such quantities that the dry layer contains about 0.1 to 25 g/m² of these substances.

The light-sensitive layer may be arranged on any layer support such as paper, synthetic resin, fabric or metal. For development at elevated temperature, the layer support must be stable at the usual temperatures employed.

In certain cases, it is advantageous to interpose an intermediate layer of layer-forming substances between the support and the emulsion layer. Layers of this type which are suitable for development at elevated temperature have been described e.g. in German Patent Specification No. 1,189,383.

The developer substances to be used according to the invention may be added to the emulsion layers which contain silver salts or to the intermediate layers in amounts of 50 to 1000 g, preferably 100 to 700 g, per mol of silver salt.

These photographic materials can be developed simply by the action of an alkaline solution after exposure to light and are, therefore, suitable both for use as negative material for the silver salt diffusion process and as copying material for processing in the two-bath process and for conventional processing by fixing and washing.

When the developer substances to be used according to the invention have been embedded in the photographic layer, they are differentiated from known developer substances such as hydroquinone, aminophenol or p-methylaminophenol etc. by their improved resistance to oxidation. Furthermore, the photographic materials produced with these developer substances have less fog.

The compounds to be used according to the invention and the photographic materials containing them are especially suitable for a heat copying process of the following type:

A photographic recording material for the production of copies by the dry process contains as oxidizing agent a silver salt which is substantially insensitive to light, a reducing agent and a light-sensitive heavy metal compound which on exposure forms metal nuclei by photolysis, thus initiating the redox reaction on heating, the reducing agent used being one or more of the compounds according to the invention represented by the general formula indicated, which compounds are capable of reducing the light-sensitive silver salt at temperatures of between 50°C and 160°C in the presence of the photolytically produced heavy metal nuclei.

Suitable oxidizing agents of the image producing redox system are silver salts of organic acids which, under the conditions of the process, are either insensitive to light or sensitive to light only to a negligible extent, e.g. silver saccharide, silver 5-chlorosalicylic aldoxime, silver 5-nitro-salicylic aldoxime or, preferably, a silver salt of a long chained fatty acid having up to 30 carbon atoms, e.g. silver stearate, silver palmitate or silver behenate or the silver salts of aliphatic carboxylic acids containing a thioether group as described in U.S. Patent Specification No. 3,330,663. Silver salts of the last mentioned bind are light-insensitive if prepared in the absence of protective colloids such as gelatin.

The light-insensitive silver salt serving as oxidizing agent and one of the compounds to be used according to the invention of the given general formula serving as reducing agent are generally used in a molar ratio of between 1:1 and 1:10.

Suitable light-sensitive heavy metal salts which when exposed to light form metal nuclei which are capable of initiating the image-producing redox reaction are e.g. inorganic or organic salts of silver, mercury or gold. The heavy metals of sub-group Ib of the Periodic System of Elements are preferred, especially silver salts and among these again the silver halides.

The most suitable light-sensitive heavy metal salts for any given redox system can easily be determined by a few simple laboratory tests. Thus, for example, the metal salt may be mixed with the components of the redox reaction in the form of its aqueous suspension. If it is to be suitable, it must no undergo any change in the dark but when the mixture is exposed to UV light, it should be undergo discoloration within a few seconds. If both these conditions are fulfilled, the heavy metal salt is suitable for the redox system.

The light-sensitive heavy metal salt is used in comperatively small quantities of about 0.05 to 0.2 % by weight, based on the weight of the oxidizing agent. This proportion of light-sensitive salt is sufficient in most cases but a higher or lower percentage may, of course, also be used.

The light-sensitive heavy metal salt, e.g. silver halide, should be present in such small quantities that the photolytically produced heavy metal nuclei are capable of initiating the redox reaction, but at the same time the concentration of the silver halide is so low that the metal nuclei formed do not cause any discoloration of the copying material, or only to a negligible extent.

The silver halide may be added to the casting solution for the layer which contains the components of the redox reaction or it may be formed in situ in the casting solution, e.g. by precipitation of the silver halide in the mixture. The silver ions for the precipitated silver halide may in that case be derived mainly from the silver salt which is not light-sensitive.

The silver salts which are not light-sensitive and which are present as oxidizing agents may be obtained in a known manner exactly like the silver halide by precipitation of silver salt solutions, e.g. by the precipitation of silver nitrate with the alkali metal salts of the organic acids preferably in the absence of protective colloids. The free acid may, of course, be present during precipitation but, in order to obtain highly transparent layers, it is advantageous to have only a slight excess of free acid present or even to use stoichiometric quantities of the organic acid and the silver salt.

Various methods may be used for preparing silver halides from the light-insensitive silver salts. For example, the surface of the light-sensitive silver salts may be treated with vapors of hydrohalic acids, e.g. hydrochloric acid, hydrobromic acid or hydriodic acid. The quantity of silver halide produced on the surface may be kept within the required limits by adjusting the concentration of the hydrogen halide in the vapor phase and the treatment time.

The light-sensitive silver salts of the organic acids may, of course, also be treated with a solution containing halogen ions, such as chloride ions, bromide ions or iodide ions. These halogen ions may be obtained from the hydrohalic acids themselves or from their salts, in particular their ammonium, alkali metal, or alkaline earth metal salts.

THe reaction of the light-insensitive silver salts with the compounds which give off halogen ions is preferably carried out with the silver salts sin the form of a suspension in a volatile, non-aqueous liquid, although also the dry salts may be reacted, for example with hydrogen halide vapors.

In addition to hydrohalic acids and their salts, e.g. the alkali metal salts, ammonium salts and alkaline earth metal salts already mentioned above and other metal salts, e.g. zinc salts and mercury salts, there may also be used for formation of the light-sensitive silver halides ionisable organic halogen compounds, e.g. triphenylmethyl chloride, triphenylemthyl bromide, 2-bromo-2-methyl propane, 2-bromo-butyric acid, 2-bromoethanol or benzophenone dichloride.

The materials according to this embodiment of the invention are preferably prepared by formation of the light-sensitive silver halides from the light-insensitive silver salts of the organic acids. This enhances the capacity of the silver halides to produce photolytic silver nuclei which are especially effective in initiating the redox reaction. Although useful materials can also be obtained by preparing the silver halides separately and subsequently mixing them with the light-insensitive silver salts, the photolytic heavy metal nuclei formed from such mixtures are generally not so active.

To prepare the material according to the invention, the components for the redox reaction and the light-sensitive heavy metal are used together with a suitable binder. The binders used are preferably organic polymers such as copolymers of vinyl chlordie and vinyl acetate or of butadiene and styrene, polyethylene, polyamides, polyisobutylene, polyvinyl chloride, polyvinylidene chloride, polyvinyl pyrrolidone, polystyrene, chlorinated rubber, polyvinyl vutyral, polymers of acrylic acid or methacrylic acid esters or copolymers of derivatives of acrylic acid and methacrylic acid, cellulose derivatives such as nitro cellulose, cellulose acetates, cellulose propionates or mixtures thereof such as cellulose acetobutyrates.

The light-sensitive layer may be used as a self-supporting layer but it is preferably applied to a suitable layer support. The layer support must be stable at the processing temperatures of between 60°C and 200°C. Suitable supports are e.g. sheets or foils of paper, cellulose acetates, polyethylene terephthalate, textile fabrics, metal foils or glass. Where paper supports are used, the paper may contain the usual suxiliary layers such as baryta layers and/or polyethylene layers.

The concentration of the reducing agent and of the oxidizing agent in the layer may vary within wide limits.

Proportions by weight of 4:1 to about 1:1 between the components of the redox reaction and the binder have generally been found sufficient.

The thickness of the light-sensitive layer may also be adapted to the requirements of the given reproduction process. Layer thicknesses of between 5 and 100 μm are generally sufficient for the usual requirements. The layer supports have the usual thicknesses of between about 0.1 and 0.8 mm.

Also in this embodiment of the invention the light-sensitive layers may be spectrally sensitized by the addition of dyes.

The usual white pigments such as silicon dioxide and toners such as phthalazone, phthalazone derivatives and phthalimide may be added to the light-sensitive layers.

The photographic materials according to the invention are processed in a known manner. Image-wise exposure is carried out with the usual light sources used in photographic work, e.g. mercury lamps, iodine quartz lamps or simple incandescent lamps. The type of light source used depends on the spectral sensitivity of the heavy metal salt. In the preferred method using silver halides, the usual incandescent lamps are sufficient. The exposure time is a few seconds.

The exposed material is then uniformly heated to a temperature of between about 60°C and 160°C. The time and temperature required for the heat treatment depends on the nature of the redox system. Periods of between 3 and 80 seconds are generally sufficient. A dark brown to black image is formed which is ready for immediate use.

EXAMPLE 1

Light-sensitive material:

An equimolar mixture of silver behenate and behenic acid is prepared by precipitating silver nitrate with a solution of sodium behenate and behenic acid in alcohol and water. The precipitate is carefully washed and dried.

The suspension used for preparation of the layer is prepared by treating the mixture described below in a ball mill for 12 hours:

240 ml of methanol, 125 ml of a 10 % solution of polyvinyl-n-butyral in methanol, 20 ml of a 10 % solution of poly-N-vinyl pyrrolidone in methanol, 30 g of an equimolar mixture of silver behenate and behenic acid, 10 ml of a 1 % methanolic solution of ammonium bromide, 1.2 g of phthalazone, and 15 g of 2,2-dimethyl-7-tert-butyl-6-hydroxy-chroman (Compound 4).

The above mixture is applied to a conventional paper support at a concentration of 100 g/sq.m and dried at room temperature.

Processing:

The light-sensitive layer is exposed through a transparent original. The source of light used is a 750 Watt UV lamp at a distance of 5 cm. The exposure time is 2 seconds and the distance from the source of light 5 cm. The material is then heated to a temperature of 80°C for 5 seconds.

A black-brown negative image of the original is obtained.

Similar results are obtained when using e.g. Compound 38 or Compound 24 instead of the compounds described above.

EXAMPLE 2

Light-sensitive material:

Suspension for bottom layer:

1.8 g of a mixture of silver behenate and behenic acid (molar ratio 1:1), 2g of cellulose acetate, 3g of phthalazone, 4.5 ml of calcium bromide solution (1 g dissolved in 100 ml of methanol), 5.7 ml of mercury-II-acetate solution (1 g + 1 ml of glacial acetic acid dissolved in 100 ml of methanol), 3ml of a solution of 1-methyl-3-allyl-5-[2-(3-ethylbenzoxazolylidene-(2)-ethylidene]-2-thiohydantoin (0.01 g dissolved in 100 ml of chloroform), 0.15 g of silicon dioxide, 55g of acetone, 1g of copolymer of vinyl chloride and vinyl acetate 88:12 dissolved in 20 g of butyl acetate.

Top layer:

10g of polyvinyl butyral, 1.5 g of phthalazone, 5g of 2-methoxy-3,3-dimethyl-5-hydroxy coumaran (Compound 38), 100 ml of methanol.

The suspension for the bottom layer is ground in a ball mill for about 16 hours and then applied on baryta paper and dried. The silver application is 0.3 to 0.4 g/m².

The top layer is cast on the dry bottom layer. The amount of reducing agent applied is 0.5 to 1.5 g/m².

Instead of Compound 38, the following reducing agents may be added to the top layer:

6 g of Compound 23, 6 g of Compound 25, 4 g of Compound 36, 5 g of Compound 4, or 5 g of a mixture of Compounds 4 and 5.

The reducing agents may also be added to the suspension for the bottom layer instead of Compound 38 to the top layer, and ground with this suspension in a ball mill for about ½ hour, e.g.:

8 g of Compound 43, 8 of Compound 33.

Processing:

The light-sensitive material is exposed with tungsten lamps for 3 to 30 seconds depending on the intensity of the lamps and the required gradation, and developed by heat. The development time varies from 3 to 80 seconds according to the height of the temperature within the range of 60°C to 160°C and the apparatus used. The apparatus used for development may be heatable presses, drying drums, rollers or the apparatus described in Belgium Patent Specification No. 628,174 or in French Patent Specifications No. 1,512,332; 1,416,752 or 1,419,101 or the usual commercial apparatus. To protect the photographic layer and to produce a high gloss image, the layer surface of the material may be kept in contact with a polyester foil during the heat development.

The images obtained on development are brown or brownish black to neutral black images on a white to yellow ground, depending on the developer substance used and the processing conditions.

EXAMPLE 3

Light-sensitive material:

The following substances are added to 1 kg of a silver chloride gelatin emulsion which contains 0.2 mol of silver halide with a silver iodide content of less than 0.1 mols %:

20 mg of 1-phenyl-5-mercaptotetrazol (1 % in alcohol), 125 g of sodium acetate (cryst.) (1:1 dissolved in water), 5 g of colloidal silicic acid, 20 g of Compound 4 or Compound 38 dissolved in methanol, and 5 ml of saponin (30 % aqueous solution).

The pH of the emulsion is adjusted to 5.1 with sulfuric acid. The emulsion is applied on a baryta paper in a known manner and dried. Silver application 1.2 g/m².

Processing:

The rear surface of the exposed negative is placed in contact for 0.5 to 60 seconds with a metal or synthetic resin surface heated to 90° to 200°C or with a liquid heat transfer agent. The apparatus used for development may be conventional heat development apparatus or heatable presses, drying drums, rollers or the apparatus described in Belgian Patent Specification No. 628,174 or the image-wise exposed negative may be exposed to infra-red radiation for about 10 to 180 seconds.

A dark brown image is obtained.

The well-covered silver image has little sensitivity to light. It may be stabilized by fixing and washing in water or by bathing it in an alcoholic solution of 2,5-dimercapto-1,3,4-thiadiazole or 1-phenyl-5-mercaptotetrazole.

EXAMPLE 4

Light-sensitive material:

A paper is coated with a solution of:

100 g of the sodium salt of polyures sulfonic acid prepared by polyaddition of the sodium salt of 4,4'-diaminodiphenylethane-2,2'-disulfonic acid with tolylene diisocyanate, 125 g of cane agar, and 2.5 liters of water.

This material is coated with the following silver halide gelatin emulsion:

1 kg of a silver chloride gelatin emulsion which contains, per kg of emulsion, 0.2 mol of silver halide with a silver iodide content of less than 0.1 mols %, 200 mg of 4-hydroxy-6-methyl-1,3,3a,7-tetraazaindene (dissolved in alcohol), 50 mg of benzotriazole (dissolved in alcohol), 100 g of sodium acetate (cryst.) (1:1 dissolved in water), 20 g of Compound 23 or Compound 4 dissolved in methanol, 3 g of colloidal silicic acid, and 5 ml of saponin (30 % aqueous solution).

The pH of the emulsion is adjusted to 4.9 with sulfuric acid. Silver application 1.2 g/m².

The material is exposed and processes as described in Example 3 and a brownish black image is obtained.

EXAMPLE 5

The following substances are added to 1 kg of an unwashed silver chlorobromide gelatin emulsion which contains per kg 0.18 mol of silver halide (20 mols % AgBr):

2.7 ml of a 40 % citric acid solution, 30 mg of 1-phenyl-5-mercaptotetrazole (1 % in alcohol), 3 g of colloidal silicic acid and 1 liter of a 10 % solution of phthalic acid in methanol.

This emulsion is added with stirring to a solution of 3 liters of a 3 % solution of a cellulose acetate (acetate group content 40 % by weight) in acetone/water (1:4) and 1 liter of a 10 % solution of phthalic acid in methanol and 60 g of Compound 38 or 60 g of Compound 43, and the emulsion is then applied to a baryta paper. Silver application 1.2 g/m².

The material is exposed and processed as described in Example 3 and a brown image is obtained.

The exposed material may also be developed for one minute in 10 % sodium hydroxide solution and fixed and washed in the usual manner. A black, well-covered image is obtained.

EXAMPLE 6

2 ml of a 40 % aqueous citric acid solution are added to 1 liter of a 10 % aqueous gelatin solution, and the solution is heated to 40°C. 22 g of 2-n-octylthio-5-carboxymethylthio-1,3,4-thiadiazole dissolved in the equimolar quantity of sodium hydroxide solution are then added and the solution is precipitated with 100 ml of a 10 % silver nitrate solution with vigorous stirring, and 1 liter of a 10 % solution of phthalic acid in methanol is added with stirring. This emulsion is added with stirring to a solution of 2 liters of a 3 % solution of a cellulose acetate (acetate group content 40 % by weight) in acetone/water (4;1) and 200 ml of a 10 % solution of phthalic acid in methanol and 50 g of Compound 38 or 50 g of Compound 25, and the emulsion is then applied to a layer support as in Example 3. Silver application 0.6 g/m². If desired, 10.2 g of 3-carboxymethylthio-1,2,4-triazole may be used instead of 22 g of 2-n-octylthio-5-carboxymethylthio-1,3,4-thiadiazole.

The material is processed as described in Example 3 and a brownish black image is obtained.

The exposed material may also be developed for one minute in a 10 % sodium carbonate solution and fixed and washed in the usual manner. A black image is obtained.

EXAMPLE 7

The following substances are added to 1 kg of a silver chloride gelatin emulsion which contains, per kg of emulsion, 0.2 mol of silver halide which has a silver iodide content of less than 0.1 mols %:

2.7 ml of a 40 % aqueous citric acid solution, 40 mg of 1-phenyl-5-mercaptotetrazole (1% in alcohol), 10 ml of a 30 % formaldehyde solution, 25 ml of a 10 % aqueous saponin solution, and 20 g of Compound 23, or 20 g of Compound 43 dissolved in methanol.

The emulsion is applied to baryta paper in a known manner and dried. Silver application 1.3 g/m².

The exposed material is developed in a 10 % aqueous sodium carbonate solution for one minute and fixed and washed in the usual manner. A well-covered black image is obtained.

EXAMPLE 8

The exposed material described in Example 7 may also be brought into contact with the image-receiving layer described hereinafter in a commercial apparatus conventionally used for the silver salt diffusion process, and developed in the following activator solution:

| | | |
|---|---|---|
| Anhydrous sodium sulfite | 40.0 | g |
| anhydrous sodium phosphate | 30.0 | g |
| sodium hydroxide | 1.5 | g |
| sodium thiosulfate cryst. | 1.0 | g |
| potassium bromide | 1.0 | g |
| made up with water to | 1 | liter |

The two layers are separated after a contact time of 15 to 30 seconds.

A black image with good whites is obtained.

Image-receiving material:

A layer of baryta is applied from the following solution to a layer support of paper (80 g/m²):

6 ml of a 50 % aqueous suspension of barium sulfate,
20 ml of a 10 % aqueous gelatin solution,
8 ml of a 50 % aqueous emulsion of polyvinyl acetate,
water up to 100 ml.

The baryta layer is dried and then coated with an image-receiving layer from the following casting solution:

4.5 g of propylene glycol alginate,
12.5 mg of silver sulfide in the form of an aqueous colloidal solution,
20 ml of a 50 % aqueous gelatin solution,
1.5 ml of a 30 % aqueous solution of potassium bromide,
1.2 ml of a 30 % aqueous solution of saponin,
7.5 g of sodium thiosulfate,
made up with water to 300 ml.

The layer is applied in such a thickness that it contains about 1.1 g of sodium thiosulfate per m².

A layer of the following casting solution is then applied to the aforesaid image-receiving layer:

3.5 g of sodium alginate,
10 g of sodium thiosulfate,
0.8 ml of a 30 % aqueous potassium bromide solution,
8 ml of a 30 % aqueous saponin solution,
0.5 ml of a 1 % a alcoholic solution of 3-mercapto-4,5-dimethyl-1,2,4,-triazole,
made up with water to 350 ml.

This layer is applied in such thickness that it contains about 0.6 g of sodium thiosulfate per m².

EXAMPLE 9

A light-sensitive photographic material comprising a silver chloride gelatin emulsion layer on a support, which emulsion layer contains per kg of casting solution 0.2 mol of silver halide with less than 0.1 mol % of silver iodide (silver application 1.3 g/m²) and Compound 38 or Compound 43 (20 g/kg of emulsion) is exposed image-wise and developed in the following activator solution in an ordinary commercial two bath apparatus:

60 g of sodium hydroxide,
50 g of anhydrous sodium sulfite
2 g of potassium bromide,
made up with water to 1 liter.

The developed material is treated with the following stabilizer solution:

250 g of ammonium thiocyanate,
80 g of potassium metabisulfite,
20 ml of acetic acid,
20 g of the sodium salt of the cyclohexanone bisulfite adduct,
made up with water to 1 liter.

A grey-black image with good whites is obtained.

If the above mentioned emulsion is mixed with phthalic acid and cellulose acetate as described in Example 5, a black image is obtained.

We claim:

1. A light-sensitive photographic material containing at least one silver salt composition which comprises a light-sensitive silver salt selected from the group consisting of silver halide, and silver salt of carboxyalkyl thioether derivatives and containing a reducing agent that after imagwise exposure causes development of a visible image by reducing the silver salt composition when processed with heat or with an alkaline bath wherein the improvement comprises the reducing agent has the following formula:

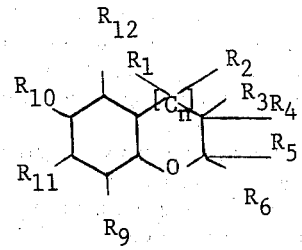

wherein $n$ is 0 or 1;

$R_1$, $R_2$, $R_3$, $R_4$, $R_5$ and $R_6$ are hydrogen or alkyl groups having up to 9 carbon atoms, but $R_3$ and $R_4$ or $R_4$ and $R_5$ may be joined together to complete a carbocyclic ring system having 5, 6 or 7 carbon atoms, and $R_6$ may further represent an alkoxy group having up to 6 carbon atoms or a tertiary amino group of the formula:

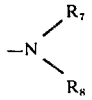

wherein $R_7$ and $R_8$ represent alkyl having up to 6 carbon atoms or are together the ring members required for completing a 5-, 6-, or 7- membered ring;

$R_9$, $R_{10}$ are hydrogen, alkyl or alkoxy having up to 6 carbon atoms, and at least one of them represents a hydroxyl group;

$R_{11}$, $R_{12}$ are hydrogen, alkyl or alkoxy having up to 9 carbon atoms, cycloalkyl, aralkyl, aryl or a group of the formula:

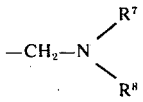

2. The light sensitive material as claimed in claim 1 wherein the reducing agent is 2,2-dimethyl-7-tert-butyl-6-hydroxy-chroman.

3. The light sensitive material as claimed in claim 1 wherein the reducing agent is 2-morpholino-3,3-dimethyl-6-tert-butyl-hydroxy-coumaran.

4. The light sensitive material as claimed in claim 1 wherein the reducing agent is 2-methoxy-3,3-dimethyl-5-hydroxy-coumaran.

5. The light sensitive material as claimed in claim 1 wherein the reducing agent is a compound of the following formula:

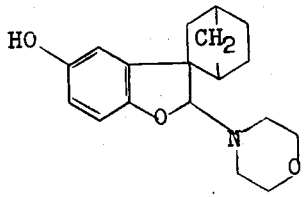

wherein $R^7$ an $R^8$ have the meanings indicated above.

6. The process for the production of photographic images by imagewise exposure of a light-sensitive photographic material containing a light-sensitiive composition which comprises silver halides and silver salt of carboxyalkyl thioether derivatives and a reducing agent that after imagewise exposure causes development of a visible image by reducing the light-sensitive composition when the sheet is processed with heat or with an alkaline bath wherein the improvement comprises the reducing agent has the formula:

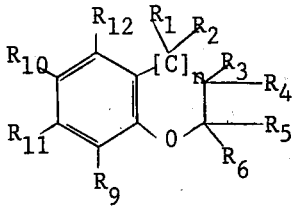

wherein $n = 0$ or 1;

$R_1$, $R_2$, $R_3$, $R_4$, $R_5$ and $R_6$ = hydrogen or alkyl groups having up to 9 carbon atoms; but $R_3$ and $R_4$ or $R_4$ and $R_5$ = may be joined together to complete a carbocyclic ring system having 5, 6 or 7 carbon atoms; and $R_6$ may further represent an alkoxy group having up to 6 carbon atoms or a tertiary amino group of the formula:

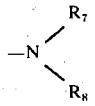

wherein $R_7$ and $R_8$ represent alkyl having up to 6 carbon atoms or are together the ring members required for completing a 5-, 6-, or 7-membered ring;

$R_9$, $R_{10}$ = hydrogen, alkyl or alkoxy having up to 6 carbon atoms and at least one of them represents a hydroxyl group;

$R_{11}$, $R_{12}$ = hydrogen, alkyl or alkoxy having up to 9 carbon atoms, cycloalkyl, aralkyl, aryl or a group of the formula:

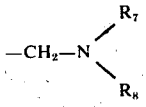

wherein $R_7$ and $R_8$ have the meanings indicated above.

7. The process as claimed in claim 6 in which the light-sensitive material contains at least one silver halide emulsion layer and the exposed material is treated with an alkaline bath.

* * * * *